United States Patent [19]

Yokoi

[11] Patent Number: 4,960,653

[45] Date of Patent: Oct. 2, 1990

[54] METHOD OF COPPER-NICKEL-CROMIUM BRIGHT ELECTROPLATING WHICH PROVIDES EXCELLENT CORROSION RESISTANCE AND PLATING FILM OBTAINED BY THE METHOD

[75] Inventor: Hiroshi Yokoi, Odawara, Japan

[73] Assignee: Kanto Kasei Co., Ltd., Yokosuda, Japan

[21] Appl. No.: 444,081

[22] Filed: Nov. 30, 1989

[51] Int. Cl.[5] ..... C25D 5/12

[52] U.S. Cl. ..... 428/613; 204/41

[58] Field of Search ..... 204/41, 16; 428/613, 428/667

[56] References Cited

U.S. PATENT DOCUMENTS

| | | | |
|---|---|---|---|
| 3,152,971 | 10/1964 | Tomaslewski et al. | 204/41 X |
| 3,449,223 | 6/1969 | Odekerken | 204/41 X |
| 3,625,039 | 12/1971 | Kuback et al. | 204/41 X |
| 3,825,478 | 7/1974 | Clauss et al. | 204/41 |
| 3,843,495 | 10/1974 | Malak | 204/41 X |
| 3,847,760 | 11/1974 | Malak | 204/41 X |
| 3,866,289 | 2/1975 | Brown et al. | 204/41 X |

*Primary Examiner*—G. L. Kaplan

*Attorney, Agent, or Firm*—Fulbright & Jaworski

[57] ABSTRACT

This invention is directed to a method of copper-nickel-chromium bright electroplating which provides excellent corrosion resistance, characterized in that said bright electroplating film comprises copper and nickel plating levers formed on a basis material or a nickel plating layer directly formed on a basis material, a microporous layer of a thickness of 0.2–2 μm codeposited on said nickel plating layer by adding calcium salt and titanium oxide to Watts bath type of nickel plating bath, chromium plating layer with a thickness of 0.01–0.25 μm on said microporous layer and a chromium plating surface with micropores of 20000–500000/cm$^2$, and is directed to the plating films obtained by the method.

2 Claims, 1 Drawing Sheet

METHOD OF COPPER-NICKEL-CROMIUM BRIGHT ELECTROPLATING WHICH PROVIDES EXCELLENT CORROSION RESISTANCE AND PLATING FILM OBTAINED BY THE METHOD

BACKGROUND OF THE INVENTION

This invention relates to a method forming copper-nickel-chromium bright electroplating being excellent in corrosion resistance for automotive or appliance, the surfaces of the parts thereof, and relates to the bright electroplating films obtained by said method.

In general, applying copper-nickel-chromium plating or nickel-chromium plating to automotives or appliances, or the surfaces of the parts thereof is most commonly used for improving the corrosion resistance of their basis materials along with for enhancing decorative effect by the combined use of painting etc.

Such copper-nickel-chromium plating or nickel-chromium plating are apt to lead to be suffered from flaw or crack at the surfaces thereof, and the existence of said flaw or crack causes corrosion progressing into the plating layer at the surface blemishes as shown in FIG. 1. Such corrosion has small anode area (nickel), therefore will provide greater corrosion current density which giving marked corrosion which also finally reaches basis material to form corrosion there. Such corrosion will possibly cause not only defects in appearance but also serious defects. To overcome such defects, it has been conducted that to employ thicker plating layers. However, a thicker plating layer has provided disadvantages either in the effective use of resources or in the costs concerned.

Then, in Japanese Patent Publication No. 15471/1981 it is disclosed that nickel platings were conducted by the use of a semi-bright nickel and bright nickel baths into which brightener and wetting agents were added, and then by the use of a nickel bath into which soluble amine compound, and aluminum or chromium ions being the most preferable metals selected from the metals in the groups III, V and VI or periodic table are added to allow minute particles to deposit on the nickel plating surface, and then chromium plating is applied thereon to provide the chromium plating surface with microporosity, resulting in small corrosion current density to obtain improved anticorrosive metal coatings. However, the number of micropores obtained by said invention are 1500–46500/cm$^2$. The number of micropores of a chromium plating which has no possibility producing any clouding are 9300/cm$^2$. Besides, when the concentration of metal ions are 0.5 g/l or more, there will occur burnt deposits harmful to plating. Therefore, when a large amount of such harmful metallic hydroxides are produced, there will be accompanied by disadvantages of requring the removal thereof by filtration.

SUMMARY OF THE INVENTION

In a method of copper-nickel-chromium electroplating or in a method of nickel-chromium electroplating, this invention relates to a method of copper-nickel-chromium bright electroplating which provides a excellent corrosion resistance, characterized in that after applying a nickel plating; using a bath prepared by the addition of 0.5–20 g/l of calcium salt with a particle diameter of 0.1–10 μm, and 0.50–10 g/l of titanium oxide with a particle diameter of 0.1–4 μm to said Watts bath type of nickel plating bath, codeposit plating of 0.2–2 μm in thickness is applied; and then 0.01–0.25 μm of chromium plating is applied to form micropores with a pore number of 20000–500000/cm$^2$, and relates to a plating film obtained therefrom.

That is, in a copper-nickel-chromium electroplating or in a nickel-chromium electroplating, this invention relates to a copper-nickel-chromium bright electroplating film being excellent in corrosion resistance, characterized in that said bright electroplating film comprising copper and nickel plating layers formed on a basis material or a nickel plating layer directly formed on a basis material; a microporous layer of a thickness of 0.2–2 μm codeposited on said nickel plating layer by adding calcium salt and titanium oxide to Watts bath type of nickel plating bath; chromium plating layer with a thickness of 0.01–0.25 μm on said microporous layer; and a chromium plating surface with micropores of 20000–500000/cm$^2$.

Figure 1:
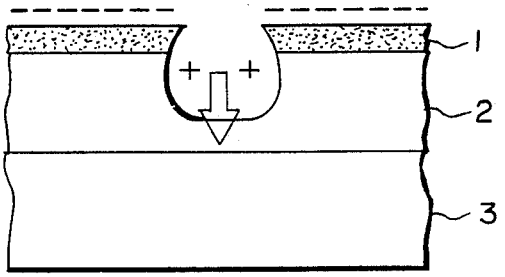
FIG. 1 (PRIOR ART)
FIG. 1 is an illustrative drawing showing corrosion mechanism of conventional plating films.

1: Cr, 2: Ni, 3: basis material

DETAILED DESCRIPTION OF THE INVENTION

In this invention, when the particle diameter of titanium oxide to be added to a Watts bath type of nickel plating bath is more than 4 μm, and the particle diameter of calcium salt more than 10 μm, said pore number will become less than 20000, which causes corrosion problems, on the contrary, when less than 0.1 μm, the number of micropores after chromium plating will be decreased because of the embeding of said fine particles into nickel codepositon layer. The particle diameters of these addition agents preferably should be 0.5–2 μm. And when the concentrations of calcium salt and titanium oxide are more than 20 g/l and 10 g/l respectively, defective plating will occur due to the decreased thermal and electrodeposition efficiencies etc. by the deposition of said addition agents on the heating pipes and electrode panels in plating vessels or on products, or due to the easy drag-in of the addition agents into the next chromium vessel. And when the concentrations of these addition agents are less than 0.5 g/l, there will be limitations to ensure the number of the pores. Preferably the concentrations of calcium salt and titanium oxide shall range 5–10 g/l and 5–9 g/l respectively.

When the film thickness of chromium plating is more than 0.25 μm, the pores will be cloged resulting in deteriorated corrosion resistance, and when less than 0.01 μm, there will occur problems of abrasion resistance. Therefore, the film thickness of chromium plating prefably should be 0.01–0.15 μm.

As for addition agent as a calcium salt, one, two or more compounds are employed which are selected from calcium carbonate, calcium chloride, calcium bromide, calcium sulfate, calcium fluoride, calcium phosphate and calcium silicate. Among which, as preferable calcium salts, the combined use of calcium chloride and calcium carbonate is desirable.

According to the prior Japanese Patent Publication stated above, the diameters of minute particles adhering to chromium plating surface shall be in the range of 0.015–10 μm, and the combined use of amorphous fine silica powder is recommended for making plating method more effective. However, such combined use is liable to cause increased size of agglomerated fine particles during plating with the result of solidification in the bottom of plating vessel, as well as poor distribution of the particles in plating bath accompanied by enlarged diameters of fine particles along with less uniformly attaching properties thereof to plating surface. On the other hand, in spite of the diameters of the fine particles according to this invention are in the range of 0.1–10 μm or 0.1–4 μm, but they do not agglomerate each other, and have excellent dispersing properties without the addition of wetting agent to the plating bath. Therefore, the particles uniformly adhere to the nickel plating surface.

As for the basis materials used in this invention, metals such as iron, copper, aluminum etc., and a variety of conductive resins obtained by specified treatments, such as acrylonitrile-butadiene-styrene resin, polyphenylene oxide resin, polyacetal resin, polyamide resin, polycarbonate resin, polypropylene resin, polyphenylene sulfide resin etc. are used.

A plating pretreatment process for basis metals such as iron etc. is conducted according to the following steps.

(1) basis abrasion (2) racking (3) cleaning (one or plural cleaning or degreasing treatments selected from alkaline dipping, electrolytic cleaning with alkaline or acid, solvent etc.)

(4) acid dipping (selected from hydrochloric acid, sulfuric acid, fluoric acid, nitric acid etc., depending on the kinds of basis metals to be used)

(5) metal displacement is conducted, depending on the kinds of metals (when aluminum is used as material)

Rinsing steps are employed between said steps as required.

A pretreatment process for basis resins is conducted according to the following steps.

(1) molding (2) racking (3) cleaning (cleaning or degreasing by alkaline or acid dipping)

(4) pre-etching (required depending on the types of resins)

(5) etching (6) catalyzation (7) activation (8) chemical plating (chemical copper plating or chemical nickel plating)

Rinsing steps are employed between said steps as required.

After said pretreatment processes, either basis metals or basis resins are electroplated. As for electroplating processes, the following steps are employed.

(1) acid or alkaline dipping (2) electro copper strike plating (3) electro copper plating (4) electro nickel plating (double or triple layers of nickel plating are applied to comply with the plating quality desired)

(5) electro nickel plating containing fine particles which is a feature of this invention.

(6) electro chromium plating

Rinsing steps are employed between said steps as required. The steps of (2) and (3) can be omitted according to the types of basis materials. Generally, as for metal basis, these steps are most commonly omitted.

Figure 2:
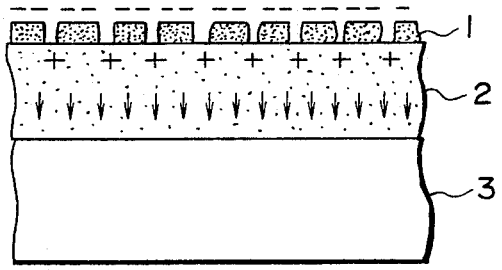
FIG. 2 is an illustrative drawing showing corrosion mechanism of plating films in this invention.

As stated above, in this invention, following on an electro nickel plating, to a Watts bath type of nickel plating bath are added calcium salt and titanium oxide, the diameter of each thereof being specified to be in the range of 0.1 to 10 μm, then the titanium oxide particles are codeposited on the nickel plating film. Succeedingly chromium plating is applied to form chromium film without adhering onto said fine particles, therefore, the deposited parts of said particles will produce micropores. And the micropores are formed as many as 20000–500000 pores/cm$^2$, therefore, corrosion current is dispersed as shown in FIG. 2 and each micropore will have unexpectionally small amount of corrosion current density providing greatly improved corrosion resistance. The addition of calcium salt increases the density of Watts bath type of nickel plating bath along with has the effect of improving dispersion properties of titanium oxide in the liquid, and also produces sulfate group and fine particles of calcium sulfate, which precipitate on the nickel film together with said titanium fine particles.

EXAMPLES

In the following, examples will be shown.

EXAMPLE 1

Electroplatings according to the following steps were applied to the basis iron and basis ABS resin which had been subjected to specified pretreatments.

(1) Acid dipping

| | |
|---|---|
| composition of bath sulfuric acid | 25–80 g/l |
| bath temperature | room temperature |
| dipping period | 5 sec.–1 min |

Rinsing (2) Copper pyrophosphate strike plating

| composition of bath | |
|---|---|
| trihydrated copper pyrophosphate | 15–25 g/l |
| potassium pyrophosphate | 60–100 g/l |
| potassium oxalate | 10–15 g/l |
| P ratio | 11–13 |
| bath temperature | 40–50° C. |
| pH | 8–9 |
| average cathode current density | 1–5 A/dm$^2$ |
| agitation | air agitation |

Rinsing (3) Acid dipping

| | |
|---|---|
| composition of bath sulfuric acid | 30–60 g/l |
| bath temperature | room temperature |
| dipping period | 5 sec.–1 min. |

(4) Composition of copper sulfate plating bath

| | |
|---|---|
| pentahydrated copper sulfate | 150–200 g/l |
| sulfuric acid | 50–90 g/l |
| chlorine | 40–100 mg/l |
| primary brightener | 3–7 ml/l |
| secondary brightener | 0.5–1 ml/l |
| bath temperature | 15–25° C. |
| average cathode current density | 1–5 A/dm$^2$ |
| agitation | air agitation |

(5) Acid dipping

| | |
|---|---|
| composition of bath hydrochloric acid | 5–10 g/l |
| bath temperature | room temperature |
| dipping period | 0.5 sec.–1 min. |

Rinsing (6) Semi-bright electro nickel plating

| composition of bath | |
|---|---|
| hexahydrated nickel sulfate | 250–350 g/l |
| hexahydrated nickel chloride | 35–50 g/l |
| boric acid | 30–50 g/l |
| brightener | 0.1–0.2 g/l |
| bath temperature | 40–60° C. |
| pH | 3.5–4.5 |

-continued

| | |
|---|---|
| average cathode current density | 1–5 A/dm$^2$ |
| agitation | air agitation |
| Rinsing | |

After rinsing, for improving the adherence between semi-bright nickel plating layers, acid dipping is conducted as required. As for acids, hydrochloric acid, sulfuric acid etc. are used.

| (7) Bright electro nickel plating | |
|---|---|
| composition of bath | |
| hexahydrated nickel sulfate | 250–360 g/l |
| hexahydrated nickel chloride | 35–60 g/l |
| boric acid | 30–50 g/l |
| primary brightener | 5–40 g/l |
| secondary brightener | 0.1–10 g/l |
| bath temperature | 40–60° C. |
| pH | 3.5–4.5 |
| average cathode current density | 1.5 A/dm$^2$ |
| agitation | air agitation |
| Rinsing | |
| Electro nickel plating | |
| hexahydrated nickel sulfate | 300 g/l |
| hexahydrated nickel chloride | 60 g/l |
| boric acid | 40 g/l |
| titanium oxide (particle diameter | 4 μm) 0.5 g/l |
| calcium carbonate (particle diameter 10 μm) | 0.5 g/l |
| pH | 3.8–4.5 |
| bath temperature | 50–60° C. |
| agitation | air agitation |
| average cathode current density | 0.5–5 A/dm$^2$ |

*As for brightener used for semi-bright nickel plating; either cumarin type or non-cumarin type of brightener can be used. As for brightener used for bright nickel plating; they are composed of primary britener containing sulfur and secondary brightener not containing sulfur.

After bright nickel plating, 0.2 μm of plating was applied by using this bath.

| Rinsing | |
|---|---|
| (9) Electro chromium plating | |
| composition of bath | |
| chromic anhydride | 150–400 g/l |
| sulfuric acid | 0.5–4 g/l |
| silicofluoride | 0.5–10 g/l |
| bath temperature | 35–55° C. |
| average cathode current density | 5–25 A/dm$^2$ |
| Rinsing | |

*As for silicofluorides, sodium silicofluoride, potassium silicofluoride, calucium silicofluoride, barium silicofluoride etc. are given.

After the chromium plating with a thickness of 0.01 μm, the number of micropores of the chrome plating surface were 20000/cm$^2$. As for iron basis, after pretreatment thereof, plating was started at the step of (5).

EXAMPLE 2

Except that the bath and conditions in the step (8) of EXAMPLE 1 were changed for the followings described below, the electroplatings in EXAMPLE 1 were repeated.

| | |
|---|---|
| hexahydrated nickel sulfate | 220 g/l |
| hexahydrated nickel chloride | 40 g/l |
| boric acid | 40 g/l |
| titanium oxide (particle diameter 4 μm) | 10 g/l |
| calcium chloride (particle diameter 10 μm) | 20 g/l |
| pH | 3.8–4.5 |
| bath temperature | 50–60° C. |

-continued

| | |
|---|---|
| agitation | air agitation |
| average cathode current density | 0.5–5 A/dm$^2$ |

Using said plating liquid, plating of 2 μm thickness was applied on the bright nickel plating, and a chromium plating of 0.25 μm thickness was applied thereon. The number of micropores on the surface of chromium plating was 40000/cm$^2$.

EXAMPLE 3

Except that the bath and conditions in the step (8) of EXAMPLE 1 were changed for the followings described below, the electroplating in EXAMPLE were repeated.

| | |
|---|---|
| hexahydrated nickel sulfate | 300 g/l |
| hexahydrated nickel chloride | 60 g/l |
| boric acid | 40 g/l |
| calcium chloride (particle diameter 0.1 μm) | 10 g/l |
| calcium carbonate (particle diameter 0.1 μm) | 10 g/l |
| pH | 3.4–4.5 |
| bath temperature | 50–60° C. |
| agitation | air agitation |

Using said plating liquid, plating of 1.0 μm thickness was applied on the bright nickel plating, and a chromium plating of 0.1 μm thickness was applied thereon. The number of micropores on the surface of the chromium plating was 500000/cm$^2$, along with the plating had a bright surface.

Using the baths described above, corresponding test specimens having micropores were prepared and tested for the CASS-test for 32 hours specified in the Appendix 2 of JIS D0201 to obtain high corrosion resistance shown in TABLE 1.

COMPARISON EXAMPLE 1

To make clear that the plating films obtained by this invention are excellent, comparison examples are shown in the following. The number of micropores on the surface of chromium plating prepared in accordance with the embodiment (d) of EXAMPLE 3 in the prior Japanese Patent Publication No. 15471/1981 was 10000 pores/cm$^2$. For comparing the corrosion resistance thereof with those of platings in this invention, platings according to this COMPARISON EXAMPLE were prepared having the same thickness as those in this invention to be tested for the CASS-test for 32 hours specified in the Appendix 2 of JIS D0201 with a corrosion resistance rating number of not more than 7.

COMPARISON EXAMPLE 2

After allowing the bath in COMPARISON EXAMPLE 1 to stand for one hour without stirring, the bath was stirred with the result of in poorly dispersed fine particles due to their adhering to the bottom of vessel. On the contrary, the fine particles in the baths according to this invention were readily dispersed.

TABLE 1

(unit of plating thickness: μm)

| basis material | plating of substrate Cu | SNi | BNi | plating of interlayer | thickness of chrome film | CASS-test after 32 hr. RN |
|---|---|---|---|---|---|---|
| iron | — | 10 | 5 | EXAMPLE 1 | 0.1 | 9.0 |
| iron | — | 10 | 5 | COMPARISON EXAMPLE 1 | 0.1 | 6.5 |
| ABS resin | 10 | 10 | 5 | EXAMPLE 1 | 0.1 | 9.5 |
| ABS resin | 10 | 10 | 5 | COMPARISON EXAMPLE 1 | 0.1 | 7.0 |

*Symbols for platings
SNi: semi-bright nickel plating
BNi: bright nickel plating
Cr: chromium plating
*RN: abbreviation for rating number

EFFECT OF THE INVENTION

In this invention, as mentioned above, as long as the number of micropores of plating surface is up to 500000/cm$^2$, a bright plating film which will produce no clouding can be obtained; plating bath can be easily controled because only two types of additives, i.e. calcium salt and titanium oxide, are used; no addition of brighteners and no filtration are needed; unexpectionally great number of micropores can be formed; therefore plating films having excellent corrosion resistance can be produced. In addition, as subsidiary effects resulted from the formation of a great number of micropores, increased inorganic micropores are obtained, which will make the apparent area of electroplating smaller at the plating surface. Therefore, chromium plating can be carried out with smaller current than that in conventional process as well as better covering power for chromium plating can be obtained.

What is claimed is:

1. In a method of copper-nickel-chromium electroplating or in a method of nickel-chromium electroplating, a method of copper-nickel-chromium bright electroplating which provides excellent corrosion resistance, characterized in that after applying a nickel plating; using a bath prepared by the addition of 0.5–20 g/l of calcium salt with a particle diameter of 0.1–10 μm, and 0.5–10 g/l of titanium oxide with a particle diameter of 0.1–4 μm to a Watts bath type of nickel plating bath, codeposit plating of 0.2–2 μm in thickness is applied; and then 0.01–0.25 μm of chromium plating is applied to form micropores with a pore number of 20000–500000/cm$^2$.

2. In a copper-nickel-chromium electroplating or in a nickel-chromium electroplating, a copper-nickel-chromium bright electroplating film being excellent in corrosion resistance, characterized in that said bright electroplating film comprised copper and nickel plating layers formed on a basis material or a nickel plating layer directly formed on a basis material; a microporous layer of a thickness of 0.2–2 μm codeposited on said nickel plating layer by adding calcium salt and titanium oxide to a Watts bath type of nickel plating bath; chromium plating layer with a thickness of 0.01–0.25 μm on said microporous layer; said chromium plating surface having micropores of 20000–500000/cm$^2$.

* * * * *